US006961027B2

(12) United States Patent
Schadler

(10) Patent No.: US 6,961,027 B2
(45) Date of Patent: Nov. 1, 2005

(54) FEED SYSTEM AND METHOD FOR INTERLEAVING A BRANCH FEED ANTENNA WITH AN EXISTING SERIES FEED ANTENNA WITHIN THE SAME APERTURE CENTERLINE

(75) Inventor: John Schadler, Raymond, ME (US)

(73) Assignee: SPX Corporation, Charlotte, NC (US)

( * ) Notice: Subject to any disclaimer, the term of this patent is extended or adjusted under 35 U.S.C. 154(b) by 127 days.

(21) Appl. No.: 10/692,688

(22) Filed: Oct. 27, 2003

(65) Prior Publication Data

US 2005/0088360 A1 Apr. 28, 2005

(51) Int. Cl.[7] ..... H01Q 1/12
(52) U.S. Cl. ..... 343/890; 343/791; 343/874
(58) Field of Search ..... 343/790, 791, 343/821, 874, 890

(56) References Cited

U.S. PATENT DOCUMENTS 6,320,555 B1 * 11/2001 Schadler ..... 343/791
6,650,300 B2 * 11/2003 Skalina et al. ..... 343/791
6,677,916 B2 * 1/2004 Skalina et al. ..... 343/890
6,768,473 B2 * 7/2004 Harland et al. ..... 343/890

* cited by examiner

*Primary Examiner*—Shih-Chao Chen
(74) *Attorney, Agent, or Firm*—Baker & Hostetler LLP

(57) ABSTRACT

An antenna system for an interleaved branch fed antenna is provided, wherein the interleaved branch fed antenna shares the same centerline as a series fed antenna. The antenna systems are easily fed while preserving similar coverage and maintaining similar aperture space.

23 Claims, 2 Drawing Sheets

FEED SYSTEM AND METHOD FOR INTERLEAVING A BRANCH FEED ANTENNA WITH AN EXISTING SERIES FEED ANTENNA WITHIN THE SAME APERTURE CENTERLINE

FIELD OF THE INVENTION

The present invention relates generally to an antenna feed system. More particularly, the present invention relates a feed system for interleaving a branch feed antenna with an existing series feed antenna.

BACKGROUND OF THE INVENTION

FM radio is in wide use in the field of radio broadcast. The term FM includes, for example, any of the Frequency Modulation methodologies used or developed for signal broadcasting in a frequency band assigned by the U.S. Federal Communications Commission (FCC), nominally in the transmission range 88 MHz to 108 MHz, which is near the middle of the Very-High-Frequency (VHF) television broadcast band. These Frequency Modulation technologies include both analog FM and digital FM.

The FCC has adopted a standard for analog-digital FM transmission called the iBiquity IBOC (In-Band-On-Channel) for hybrid analog-digital transmission systems. According to the IBOC standard, FM stations in the United States must be able to simultaneously broadcast analog and digital signals within their current allocated frequency range. One approach for achieving the above simulcast is to use two separate transmission systems (i.e., analog-digital) to feed two separate antennas (i.e., analog-digital). Since the elevation of the antenna on the tower directly affects the antenna's coverage, it would be desirable to co-locate the analog and digital signals at the same height above the ground to maintain the same coverage.

Also, since the azimuthal pattern of an FM antenna is very dependent on the cross section of the tower structure, it would be desirable to mount both the analog and digital antennas in the same orientation with respect to the tower. When adding digital coverage, concerns are that many towers are already full having no additional aperture space available. Therefore, many FM broadcasters have responded by vertically interleaving the second digital antenna within the aperture of their existing analog antenna. One challenge to overcome when antennas are placed in this configuration is a practical feed system which allows for both systems to occupy the same aperture space without deleteriously altering the characteristics of the pre-existing antenna system.

Accordingly, it is desirable to provide systems and methods which enable an antenna system added to the same general aperture space of a pre-existing antenna system to be fed without extensive design modifications or interference with the pre-existing antenna system.

SUMMARY OF THE INVENTION

The foregoing needs are met, to a great extent, by the present invention, wherein in systems and methods are provided wherein a secondary antenna system is added to the same general space of a pre-existing antenna system while being fed in a manner that does not significantly affect the pre-existing antenna system or tower.

For example, in accordance with one embodiment of the present invention, an antenna feed for a branch fed antenna interleaved with a series fed antenna, sharing a common centerline is provided, the antenna feed, comprising a first antenna feed housing, the first housing having a hollow portion capable of accommodating a first antenna feed line and capable of being attached to an antenna tower, and a second antenna feed housing having a hollow portion, the second housing being affixed to the first housing, the second housing comprising a second antenna feed line input at a side of the second housing, a balun attached to an other side of the second housing, an outer conductor interior to and coaxial with the balun, and an elbow shaped joint within the second housing's hollow portion, connecting the input to the outer conductor, the elbow joint being insulated from the balun and the second housing.

In accordance with another embodiment of the present invention, an antenna feed for a branch fed antenna interleaved with a series fed antenna, sharing a common centerline is provided, comprising a first housing means for housing a first antenna feed and having a hollow portion and attachable to an antenna tower.

In accordance with yet another embodiment of the present invention, a method for feeding two sets of interleaved antennas sharing a common centerline, the method comprising feeding a first interleaved antenna element of a first antenna set using a series feed, and feeding a second interleaved antenna element of a second antenna set using a branch feed, wherein the branch feed is centrally accommodated to enable the series feed to pass through to feed a next interleaved antenna element of the first antenna set.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways within the preview of one of ordinary skill in the art. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
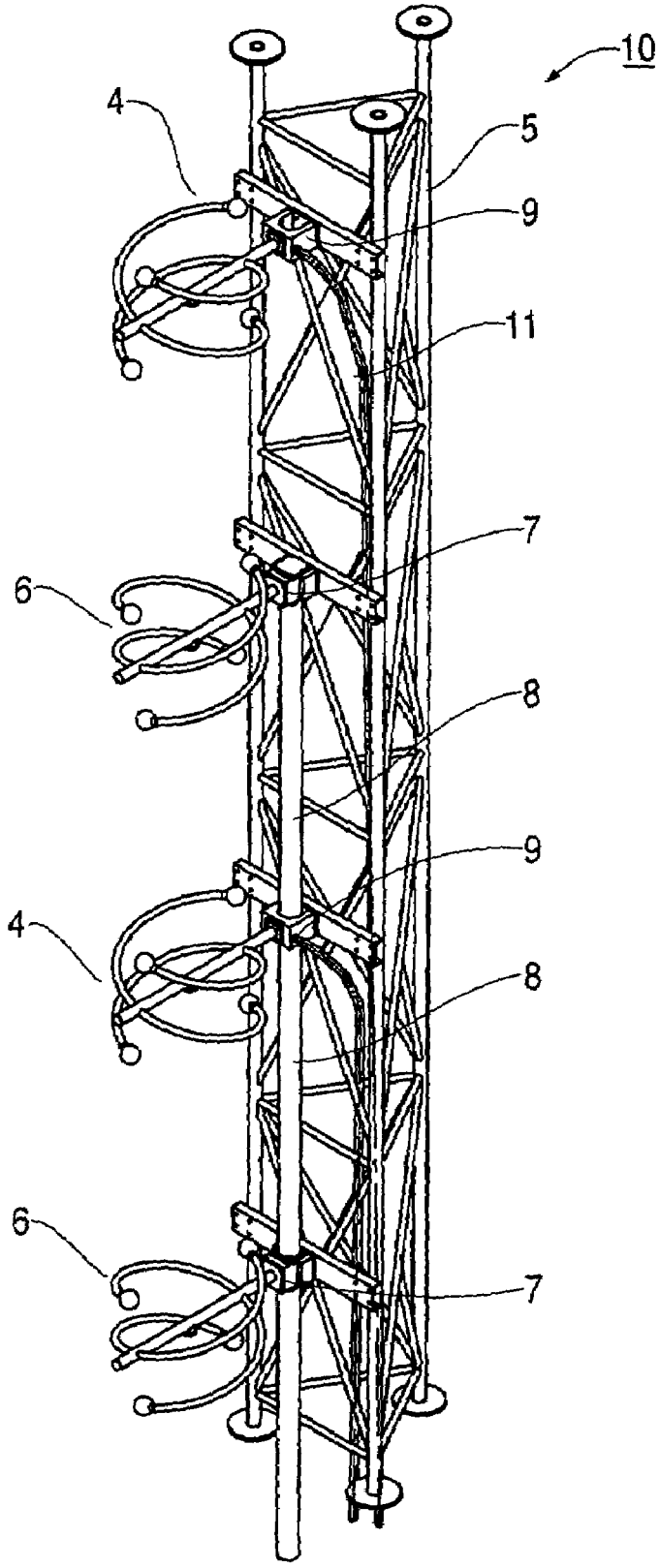
FIG. 1 is an illustration of an exemplary branch feed antenna configuration interleaved within a series feed antenna system.

The invention will now be described with reference to the drawing figures, in which like reference numerals refer to like parts throughout.

Due to the FCC IBOC requirements several practitioners in the antenna community have devised methods or systems for interleaving analog-digital feed lines to the main antenna. For example, U.S. patent application Ser. No. 10/396,818 titled "Apparatus and Method of Isolating In-Channel FM Antennas Sharing Common Aperture Space" filed Mar. 26, 2003 by the present inventor, the contents of which are incorporated herein by reference in its entirety describes the possibility of interleaving antennas.

FIG. 1 an illustration 10 of an exemplary radiating tower 5 with interleaved branch feed digital left-hand polarized antennas 4 within the same centerline of series fed analog right-hand polarized antennas 6. By interleaving the digital left hand-polarized antennas 4 with the analog right-hand polarized antennas 6, coupling between the antennas 4 and 6 is greatly reduced. Therefore, only a small, low cost circulator is need at the output of the respective transmitter (not shown) to absorb the small amount of coupled energy to achieve the necessary isolation between analog and digital transmission systems. Since both the digital and analog antennas 4 and 6, respectively, will have the same approximate tower geometry adjacent to them, the azimuth patterns of both systems will be virtually the same and will meet FCC pattern requirements.

The series feed antennas 6 are shown as being fed from feed block housings 7 which are attached to feed line assembly 8 that is attached to the tower 5. Each antenna of the series fed antennas 6 is separated by approximately 1 λ to provide in-phase constructive interference. The branch feed antennas 4 are interleaved at ½ λ intervals between the series feed antennas 6 and are fed by branch line feed line 11 that are fed into the branch feed block input housings 9.

Figure 2:
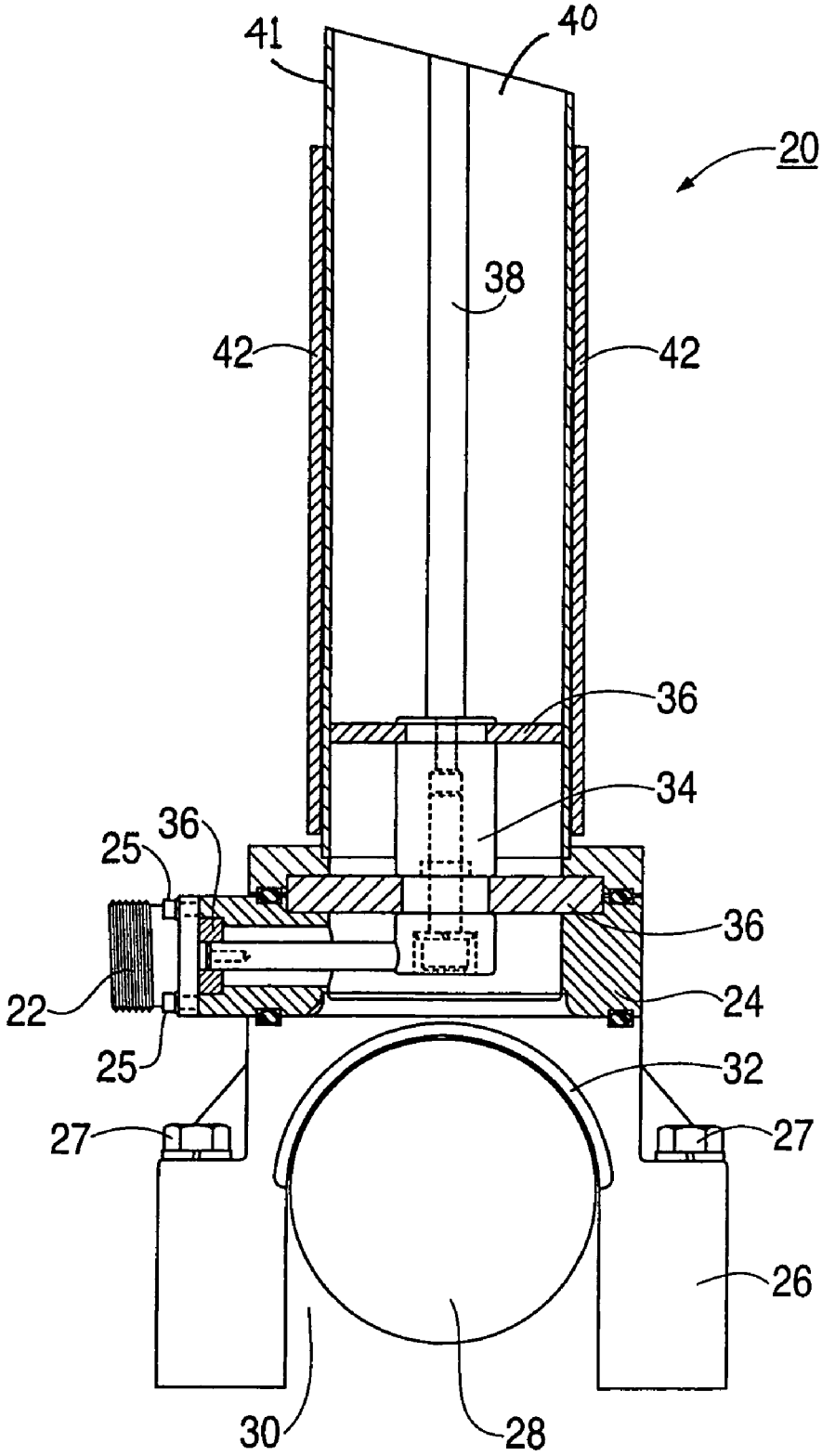
FIG. 2 is cross sectional view of a section an exemplary branch feed input.

The branch feed block input housings 9 are similar in general appearance to the series feed block input housings 7, except that accommodation is made for a branch feed line (discussed in FIG. 2). It should be noted that the uppermost branch feed block input housing 9 does not need to encompass the feed line assembly 8, as the feed line feeding analog power or signal is not needed at the uppermost branch feed digital antenna element 4.

It should be apparent that the interleaving of the series and branch feed antennas 6 and 4, respectively, over a common centerline of a face of the tower 5 results in all of the secondary (e.g., branch feed) antennas 4 to "share" the feed line assembly 8, with the exception of the "last" secondary antenna 4. Accordingly, it should be apparent that while FIG. 1 illustrates the "first" antenna to be a series feed antenna 6, the design could be alternated to where the "first" antenna is a branch feed antenna 4. Consequently, the "last" antenna element would be part of the series feed antenna 6, with the attendant feed line assembly 8 extending thereto, with the "last" block input housing being a series feed block input housing 7.

It should be appreciated by one of ordinary skill in the art that while the above discussion phrases the various elements of the exemplary embodiment of FIG. 1 in terms of "last", "first" and "secondary", these terms are relative and may be interchanged depending on the design and preferences implemented. Also, while 1 λ spacing is used between antenna elements of the same antenna system, other spacings as deemed efficient maybe used, as desired. Furthermore, it should be appreciated that while FIG. 1 illustrates the feed line assembly 8 and attendant antenna elements as located in the center of one face of the tower 5, alternative positioning of the antenna system may be accomplished, as desired. For example, two or more faces of the tower 5 may have antenna systems located therein. Similarly, rather than positioning the antenna system solely on a face, the antenna system may be positioned on "corners" or at other suitable locations of the tower. Further, while the tower 5 is shown to have three faces, the tower 5 can have more or less faces as desired.

In FIG. 1, each branch 4 and series 6 fed antenna system is composed of circularly polarized helically wound antenna elements. For the purposes of this explanation, the series fed antenna elements 6 are presumed to be the pre-existing "analog" antenna, while the branch fed antenna elements 4 are presumed to be the added "digital" antenna. The antenna elements of the respective analog-digital systems are oppositely polarized between the digital and analog antennas to achieve a high level of isolation, being co-located in the same aperture window.

As is apparent to one of ordinary skill, numerous types of non-helical antenna elements are available that can radiate circularly polarized signals and are thus suitable for simulcasting analog and digital signal in a single aperture window. While some antenna types do not intrinsically radiate circularly polarized signals, they can be forced to create such a signal when driven by properly configured antenna elements and/or phasing. For example, two sets of crossed linear dipoles may be properly phased to generate opposing circular polarizations. Therefore, while the above exemplary embodiments illustrate one style of antenna elements, other forms of antennas, either by physical or by signal manipulation, may generate orthogonal signals to achieve reduced cross-coupling.

Due to the exemplary interleaving and feed approach provided in FIG. 1, a very low cost solution to FCC requirements is provided. Specifically, the cost of the secondary (digital) antenna 4, second run of low power (digital) transmission line and low power circulator is substantially less than the system cost of a 10 dB coupler and a transmitter large enough to compensate for additional system losses.

Also, the exemplary system 10 also provides a lower risk as each of the analog and digital arrays are separate from each other and therefore can be operated independently. Because of the reduced mutal coupling re-tuning requirements of the analog antenna after installing the digital bays can be minimized. Additionally, two interleaved antennas 4 and 6 provide a level of redundancy since both arrays are capable of supporting either the analog or digital signal based on the input signal.

While FIG. 1 shows 4 bays situated on the tower 5, more or less bays can be configured, given the current implementation. Of course, less or more bays may be facilitated, based on power, antenna patterns, etc. In fact, it should be appreciated that what FIG. 1 illustrates an interleaving paradigm with only two separate antenna systems, multiple sets (e.g., more than two sets of antennas) may be situated within the antenna tower 5. That is, three or more pairs or sets (having at least two antennas in the set) maybe vertically placed in the tower 5. The additional or odd antenna set may utilize an antenna feed that is, for example, on an alternating side of the antenna as compared to the non-odd antenna set. Accordingly, branch feed lines 11 feeding alternating pairs of secondary antennas may lay on both sides of the centerline assembly 8.

FIG. 2 is an illustration of a cross sectional view of an exemplary side feed input 20. The side feed input 20 is shown with a side mounted threaded knurl 22 for connection to a transmission line (not shown). The threaded knurl 22 is connected to a feed block assembly 24 via mounting or attachment bolts 25. The feed block assembly 24 is attached to a mount 26 which is in turn attached to the tower 5 via bolts 27. The mount 26 has an internal cavity 30 for situating the second interleaved antennas feed line 28. To protect the antenna feed line 28, cushioning shoe 32 is placed on an inner surface of the mount 26.

The feed block assembly 24 contains an internal cavity for housing an elbow joint 34. The elbow joint 34 is supported and insulated from the rest of the bay assembly 24 via insulating inserts 36. The "upper extremity" of the elbow joint 34 is connected to inner conductor 38 which travels through the balun 40 to the antenna radiators (not shown). The balun 40 and the feed block assembly 24 is strengthened with a reinforcing collar 42. By implementing a side fed feed block 20 as illustrated in FIG. 2, a secondary antenna situated over the same center line can be easily fed. Therefore, no modifications are necessary to an existing antenna structure. The side fed feed blocks 24 are not attached to the series fed antennas feed line and thus will not add any new stresses to the analog system.

It should be appreciated that though the above exemplary embodiments are described in the context of IBOC applications, non-IBOC applications may be contemplated. That is, for example, any antenna system requiring "sharing" of a centerline can be fed. Additionally, while FIG. 2 illustrates the use of bolts 25 and 27, they may be replaced with any suitable equivalent. Also, while the input feed block 20 is presumed to be fabricated from two or more joined pieces (i.e., block assembly 24 and mount 26), the feed block 20 maybe fabricated as a single piece, depending on machining and fabricating capabilities.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An antenna feed block for a branch fed antenna interleaved with a series fed antenna, sharing a common centerline, comprising:

a first antenna feed housing, the first housing having a hollow portion capable of accommodating a first antenna feed line and capable of being attached to an antenna tower; and a second antenna feed housing having a hollow portion, the second housing being affixed to the first housing, the second housing, comprising:

a second antenna feed line input at a side of the housing;

a balun attached to an other side of the second housing;

an inner conductor interior to and coaxial with the balun; and an elbow shaped joint within the second housing's hollow portion, connecting the input to an outer conductor, the elbow joint being insulated from the balun and the second housing.

2. The antenna feed block according to claim 1, wherein the orientation of the first feed line and the orientation of the second feed input are substantially transverse with respect to each other.

3. The antenna feed block according to claim 1, wherein the balun is substantially perpendicular to the orientation of the second feed line.

4. The antenna feed block according to claim 1, further comprising: a reinforcing collar about a portion of the balun.

5. The antenna feed block according to claim 1, wherein the input has a threaded surface.

6. The antenna feed block according to claim 1, wherein the elbow joint is insulated from the balun and the second housing with a plurality of insulators.

7. The antenna feed block according to claim 6, wherein the insulators support the elbow joint.

8. The antenna feed block according to claim 1, wherein the hollow portion of the first housing contains a material capable of substantially absorbing an impact of the first feed line on the first housing.

9. The antenna feed block according to claim 1, wherein the first antenna feed line carries an analog electromagnetic signal and the second antenna feed line carries a digital electromagnetic signal.

10. The antenna feed block according to claim 9, wherein the first antenna feed line carries a radio frequency digital signal and the second antenna feed line carries a radio frequency analog signal.

11. The antenna feed block according to claim 9, wherein the electromagnetic signals are FM radio signals.

12. An antenna feed block for a branch fed antenna interleaved with a series fed antenna, sharing a common centerline, comprising:

a first housing means for housing a first antenna feed and having a hollow portion and attachable to an antenna tower;

a second housing means for housing a second antenna feed having a hollow portion and attachable to the first antenna feed housing means; the second housing means comprising:

a balun;

an electrical conducting means inside the balun;

an antenna feed line input; and a connecting means for electrically connecting a signal from the input to the electrical conducting means.

13. The antenna feed block according to claim 12, wherein the orientation of the first feed and the orientation of the second feed are substantially transverse with respect to each other.

14. The antenna feed block according to claim 12, wherein the balun is substantially perpendicular to the orientation of the second feed.

15. The antenna feed block according to claim 12, further comprising:

a reinforcing means about a portion of the balun.

16. The antenna feed block according to claim 12, wherein the antenna feed line input has a mating means for mating the second antenna feed to the second housing means.

17. The antenna feed block according to claim 12, wherein the conducting means is insulated from the balun and the second housing means with an insulating means.

18. The antenna feed block according to claim 17, wherein the insulating means also support the connecting means.

19. The antenna feed block according to claim 12, wherein the hollow portion of the first housing means contains a shock absorbing means for absorbing an impact of the first feed on the first housing means.

20. A method for feeding signals to two sets of interleaved antennas sharing a common centerline, the method comprising:

feeding a first signal to a first interleaved antenna of a first antenna set using a series feed; and feeding a second signal to a second interleaved antenna of a second antenna set using a branch feed, wherein the branch feed is centrally accommodated to enable the series feed to pass through to feed a next interleaved antenna element of the first antenna set.

21. The method according to claim 20, wherein the second signal is a electromagnetic digital signal.

22. The method according to claim 20, wherein the first and second signals are simultaneously transmitted.

23. The method according to claim 20, wherein there are a plurality of branch feeds and series feed.

* * * * *